US012773594B2

(12) United States Patent
Maybin

(10) Patent No.: US 12,773,594 B2
(45) Date of Patent: Oct. 27, 2026

(54) APPARATUS FOR TRACKING KINESTHETICS

(71) Applicant: Landon Chandler Maybin, Zirconia, NC (US)

(72) Inventor: Landon Chandler Maybin, Zirconia, NC (US)

( * ) Notice: Subject to any disclaimer, the term of this patent is extended or adjusted under 35 U.S.C. 154(b) by 44 days.

(21) Appl. No.: 18/445,334

(22) Filed: Jul. 17, 2023

(65) Prior Publication Data

US 2025/0025748 A1 Jan. 23, 2025

Related U.S. Application Data

(60) Provisional application No. 63/475,057, filed on Oct. 11, 2022.

(51) Int. Cl.
*A63B 24/00* (2006.01)
*A63B 21/072* (2006.01)

(52) U.S. Cl.
CPC ..... *A63B 24/0062* (2013.01); *A63B 21/072* (2013.01); *A63B 2220/51* (2013.01); *A63B 2220/54* (2013.01); *A63B 2220/833* (2013.01); *A63B 2225/20* (2013.01); *A63B 2225/50* (2013.01)

(58) Field of Classification Search
CPC ..... A63B 24/0062; A63B 2220/51; A63B 2220/54; A63B 2220/833; A63B 2225/20; A63B 2225/50; A63B 2220/40; A63B 2220/803
See application file for complete search history.

(56) References Cited

U.S. PATENT DOCUMENTS

2008/0119763 A1* 5/2008 Wiener ..... A61B 5/224 600/587
2014/0248996 A1* 9/2014 Adel ..... H04W 4/80 482/8
2016/0101320 A1* 4/2016 Tsutsui ..... A63B 21/4043 482/8
2016/0346617 A1* 12/2016 Srugo ..... G16H 40/40
2017/0128765 A1* 5/2017 Garretson ..... G16H 20/30
2017/0319902 A1* 11/2017 Patel ..... A63B 24/0075
2020/0206568 A1* 7/2020 Hong ..... A63B 24/0006
2021/0309524 A1* 10/2021 Nishikawa ..... C01B 32/22
2022/0080262 A1* 3/2022 Pluschkell ..... G06N 3/045
2022/0133198 A1* 5/2022 Popov ..... A61B 5/1107 73/379.01
2022/0241646 A1* 8/2022 Anderson ..... A63B 24/0062
2022/0339499 A1* 10/2022 Malis ..... G16H 40/63
2023/0028833 A1* 1/2023 Ng ..... A61B 5/1118
2023/0137222 A1* 5/2023 D'Ambrosio-Correll ..... A61B 5/743 482/8
2024/0316390 A1* 9/2024 Yazdanshenas .... A63B 21/0724

* cited by examiner

*Primary Examiner* — Sundhara M Ganesan
(74) *Attorney, Agent, or Firm* — Alston & Bird LLP

(57) ABSTRACT

An exercise tracker configured to be removably securable to a piece of equipment having at least one force sensor programmed to output a signal representing a force applied to the equipment.

20 Claims, 4 Drawing Sheets

APPARATUS FOR TRACKING KINESTHETICS

CROSS-REFERENCE TO RELATED APPLICATION

The present disclosure claims the benefit of priority of U.S. Provisional Patent Application No. 63/475,057, filed on Oct. 11, 2022, and entitled "Apparatus & Method for Tracking Kinesthetics."

FIELD OF THE INVENTION

This application, disclosed claims, and embodiments generally related to an exercise device configured for tracking exercise data, and more particularly, an exercise tracking unit being relocatably securable and configured to record, store, and process exercise data.

BACKGROUND OF THE INVENTION

This description relates to exercise equipment configured for tracking and processing exercise data, and method of the same.

The advent of smaller more powerful computers and sensors has provided means for developing devices, such as pedometers and heart rate monitors, that dramatically increase the accuracy and ease that data concerning one's health is obtained and processed. Further, the increasing ease with which digital data can be recorded via wireless communication has led to a proliferation of technologies that allow the user to track a variety of parameters including their physical fitness activities.

Fitness trackers that are able to record and remit data obtained from physical exercise are increasingly common. Such technology is critical to improving physical fitness. The fitness trackers that have gained increasingly significant popularity are only able to provide metrics that measure their physical activity and progress toward fitness goals in limited areas. Such trackers primarily focus on monitoring exercises such as running, walking, cycling, swimming, jogging, etc. Unfortunately, this approach neglects a crucial approach to fitness through strength training.

Certain exercises, for example, barbell exercises such as bench presses, squats, deadlifts, and overhead presses, are difficult to be tracked and understood by a user. Athletes and fitness enthusiasts often are relegated to subjective estimations or manual tracking methods to track and understand their workouts. Further, such techniques do not provide adequate numerical data that can be reliably examined to gather information about progress. This lack of precise and reliable exercise data stifles their ability to track, measure, and optimize their workout routine.

Accordingly, a need continues to exist and is recognized for improvements to devices and apparatuses for improving the ease and effectiveness of tracking data during exercise.

This background information is provided for the purpose of making information believed by the applicant to be of possible relevance to the present invention. Notwithstanding, no admission is necessarily intended, nor should it be construed, that any of the preceding information constitutes prior art against the present invention. in addition, the preceding information should not be construed to mean that a search has been made or that no other pertinent information as defined in 37 CFR § 1.56(a) exist.

SUMMARY

The present disclosure provides a method and apparatus for recording, tracking, and/or assessing data obtained during physical activity. All references mention in this disclosure are hereby incorporated by reference in their entirety.

One aspect of the invention pertains to a device, the device comprising a tracking unit having a hollow structure adapted for containing at least one sensor therein and having an out surface prepared with at least one hole. The embodiment further includes at least one computer operatively coupled and in communication with the tracker. In such embodiment, the at least one holes are configured to de detachably securable to an external surface and the at least one computer is configured to determine one or more inputs.

A further aspect of the invention pertains to a physical activity tracker including a module, a plurality of protrusions extending from the module that are configured to be detachably couplable with at least one piece of exercising equipment. Such an embodiment includes a deformable base that deforms in accordance with the movement of the equipment. Further, such an embodiment includes at least one processor in operable communication with said force sensor configured to receive the force signal and determine exercise data.

A yet further aspect of the invention pertains to an exercise system comprising at least one item of exercise equipment having variable weight, at least one pulley, a cable, an elastomeric band, a barbell, or a dumbbell and a tracker attached to the item or exercise equipment, the tracker having a base, at least one eyelet where the eyelet is configured to be releasably attachable to the item of exercise equipment and wherein the tracker is configured to be deformably responsive in accordance with movement of said item of equipment. Such an aspect of the invention further includes at least one sensor programmed to output a signal and at least one processor programmed to receive the signal.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION

Definitions

Figure 1:
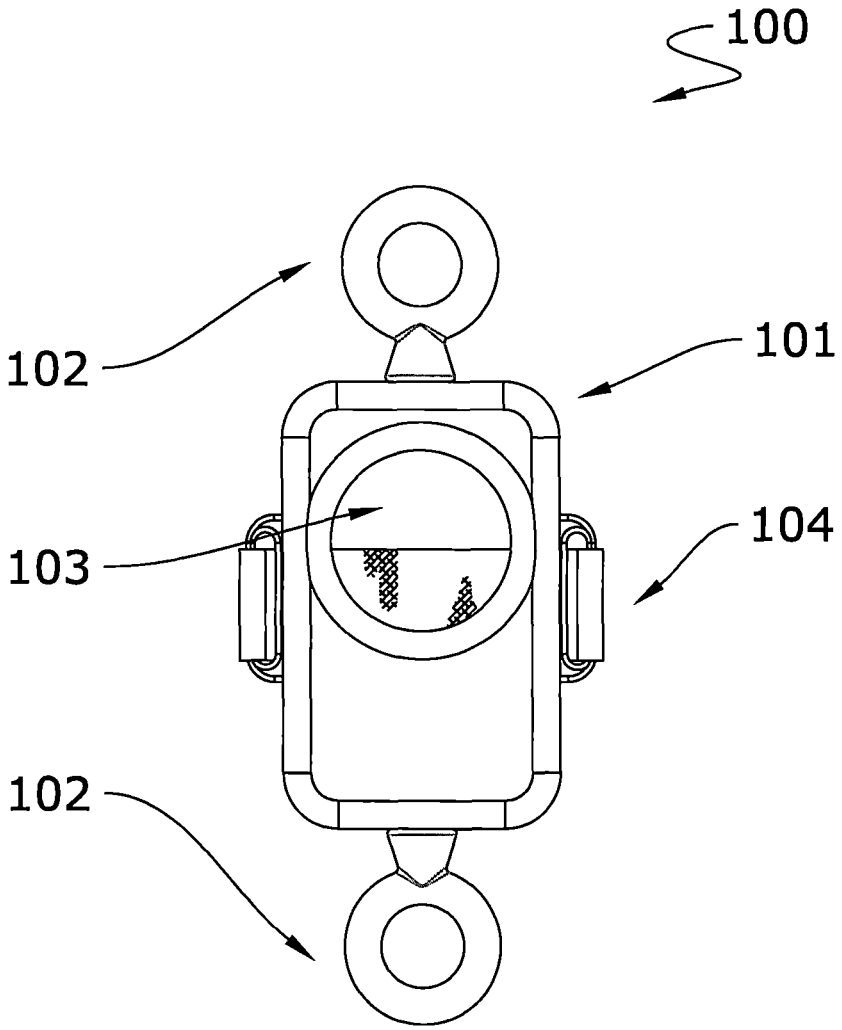
FIG. 1 is a top view of an exemplary embodiment of a device according to the present disclosure.

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated invention, and further applications of the principles of the invention as illustrated therein are herein contemplated as would normally occur to one skilled in the art to which the invention relates.

Unless defined otherwise, all technical and scientific terms used herein have the same meaning as commonly understood by one of ordinary skill in the art to which this invention pertains.

For the purpose of interpreting this specification, the following definitions will apply and whenever appropriate, terms used in the singular will also include the plural and vice versa. In the event that any definition set forth below conflicts with the usage of that word in any other document, including any document incorporated herein by reference, the definition set forth below shall always control for purposes of interpreting this specification and its associated claims unless a contrary meaning is clearly intended (for example in the document where the term is originally used).

The use of "or" means "and/or" unless stated otherwise.

The use of "a" or "an" herein means "one or more" unless stated otherwise or where the use of "one or more" is clearly inappropriate.

The use of "comprise," "comprises," "comprising," "include," "includes," and "including" are interchangeable and not intended to be limiting. Furthermore, where the description of one or more embodiments uses the term "comprising," those skilled in the art would understand that, in some specific instances, the embodiment or embodiments can be alternatively described using the language "consisting essentially of" and/or "consisting of."

As used herein, the term "about" refers to a ±10% variation from the nominal value. It is to be understood that such a variation is always included in any given value provided herein, whether or not it is specifically referred to.

As used herein, the term "exercise equipment" generally refers to any apparatus or device used during physical activity.

As used herein, the term "exercise data" generally refers to any data or information relevant to an exercise.

As used herein, the term "load bearing" generally refers to any element of a structure that has been adapted with suitable cross section, material, design, or the like to withstand a load without plastic deformation.

As used herein, the term "workout equipment" generally refers to any apparatus or device used during physical workouts to enhance the strength or conditioning effects of that exercise by providing either fixed or adjustable amounts of resistance. Examples include but are not limited to dumbbells, barbells, cable machines, elastic bands, rowers, harnesses, weight plates, variable resistance machines, and the like. The term "Exercise equipment" is to be used synonymously with "workout equipment"

It will be readily understood that the components of the present invention, as generally described and illustrated in the figures herein, may be arranged and designed in a wide variety of different configurations. Thus, the following detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present invention. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

The present disclosure generally relates to improved methods and devices for gathering, storing, and displaying exercise data. Moreover, the devices optionally include modularity which in some embodiments would allow a user to relocate the device to a multiplicity of equipment.

Advantageously, in some embodiments, the devices and methods of the present disclosure include features that provide a plurality of connecting means thereby allowing the device to be connected to essentially any article of exercise equipment. Further still, in some embodiments, the devices of the present disclosure provide a computational system to engage with a display for display of exercise data.

Again, the present disclosure generally provides a digital fitness tracker that is operable to connect to a variety of exercise equipment. The device comprises of a body that, when attached to at least one article of exercise equipment, allows a user to obtain data and transmit data pertaining to an exercise. It is envisioned that such a device is operable to provide feedback of a user's workout for each movement and throughout the workout. In some embodiments, the device is configured to interact with a cloud-based or network-based application, such as an app or program. It is envisioned that an embodiment of the device according to the present disclosure is able to communicate with, for example, a fitness app or virtual trainer.

One aspect of the device of the present disclosure includes a tracker having a body configured to be releasably attached to an article of exercise equipment, for example, a dumbbell, barbell, or cable. In some embodiments, the device may be clamped, adhered, fastened, or placed on a surface of a piece of exercise equipment. One object of the invention includes a GPS unit configured to track the position of the tracker. In addition to the GPS unit, at least one accelerometer that is operable to measure the acceleration of a body in its own instantaneous rest frame may be installed. The combination of the GPS and optional accelerometer may be operable to track a travel path of an article of workout equipment. It is envisioned that such a travel path may be plotted to better visualize an exercise. In some embodiments, such a tracker is able to identify at least one repetition of an exercise completed. In some embodiments, the unit is configured to track at least one of tension and resistance. One example of the device according to the present disclosure includes a tracker body, the body defining a center having a hollow hole of sufficient dimension to mount onto the end of a barbell or dumbbell. In some embodiments, the inner surface of said hole includes a non-slip mechanism or coating to ensure secure attachment to the barbell. It is envisioned that the tracker is able to securely fasten to, for example, a barbell in a suitable fashion to withstand repetitive motions and vibrations associated with weightlifting.

It is envisioned that the tracker is configured to measure and retain numerical data related to an invention. Further, the data is stored on a medium that is accessible by, for example, the user, a coach, or a trainer. It is envisioned that such data is relayed for the purpose of gaining insightful information regarding an exercise. For example, by way of the exercise tracker measuring any of the path, speed, velocity, tempo, rest intervals, and resistance of a lift a user can compare the performed lift to an ideal lift. In a further example, a user may connect a plurality of tracker to a single bar to track any of levelness, balance, and/or variation in position and load.

When the device of the present disclosure is attached to an exercise machine, the tracker can calculate the differential force exerted thereon. Tracking such a force is useful, for example, when utilizing dumbbells that may have differential motion in relation to each other. Further, in some embodiments, the tracker is configured to relay information regarding varying exercise equipment.

It is envisioned that the electronics that are located within the tracker body include, in a non-exhaustive list fashion: an inertial measurement unit, a strain gauge, an accelerometer, a gyroscope, a global positioning sensor, a control board, a microprocessor, memory storage, and wireless connectivity capabilities, and a thermocouple. It is further envisioned that the tracker according to the present disclosure is operable to communicate with at least one additional fitness tracker of the present disclosure. The microprocessor may be equipped with algorithms to analyze the sensor data in real-time for the purpose of extracting essential metrics such as range of motion, power output, velocity, and force exertion. In some embodiments, a proximity sensor that is operable to detect the presence of nearby objects without any physical contact may be included. It is envisioned that, in some embodiments, such a proximity sensor is operable to interact with another object in a workout space, such as equipment, materials, a tracker, or the like.

In some embodiments, the fitness tracker is adapted to be compact, lightweight, and robust. In its present form, it is envisioned that the components will work in harmony to gather, progress, and transmit exercise-related data to a display, a mobile phone, or a companion device. The tracker can b wirelessly connected to a companion mobile application or fitness monitoring platform via, for example, Bluetooth or a similar technology. Through such a connection, the user, trainer, etc. can view real-time exercise data, track progress throughout the workout, set personalized goals, and receive actionable insight to optimize the workout routines. In some configurations, the data may be directed to and evaluated by a coach. In such scenario, for example, the device may facilitate a response by the coach to the user. The device according to the present disclosure may also facilitate the user to share their achievements, compete with friends, and engage in a supportive fitness community.

FIG. 1 shows a top view of one embodiment of an exercise tracking device 100 according to the present disclosure. Such a device includes a hollow tracker body 101 adapted for containing therein at least one sensor. Examples of such sensors to be incorporated therein include, but are not limited to: accelerometers, strain gauges, potentiometers, gyroscopes. On the exterior surface of the tracker body 101 is at least one attachment means 102 for securing the tracker body 101 to an external item. It is envisioned that the tracker may be attached to an article of exercise equipment in a manner that places the device in tension. At such time the device is placed under tension, one or more of said sensors may register the load & duration and record such load as exercise data.

Continuing with FIG. 1 in some embodiments, a hollow cavity 103 is envisioned disposed thereon said tracker body 101 being adapted to secure said tracker body 101 on an article of exercise equipment. In some embodiments, the device may include at least one securement strap configured to secure said tracker to an article of exercise equipment. In some embodiments, said securement hole 104 is sizably configured to mount onto the end of a barbell or dumbbell. In such a configuration, it is envisioned that the tracker 100 may collect information such as acceleration and position.

Figure 2:
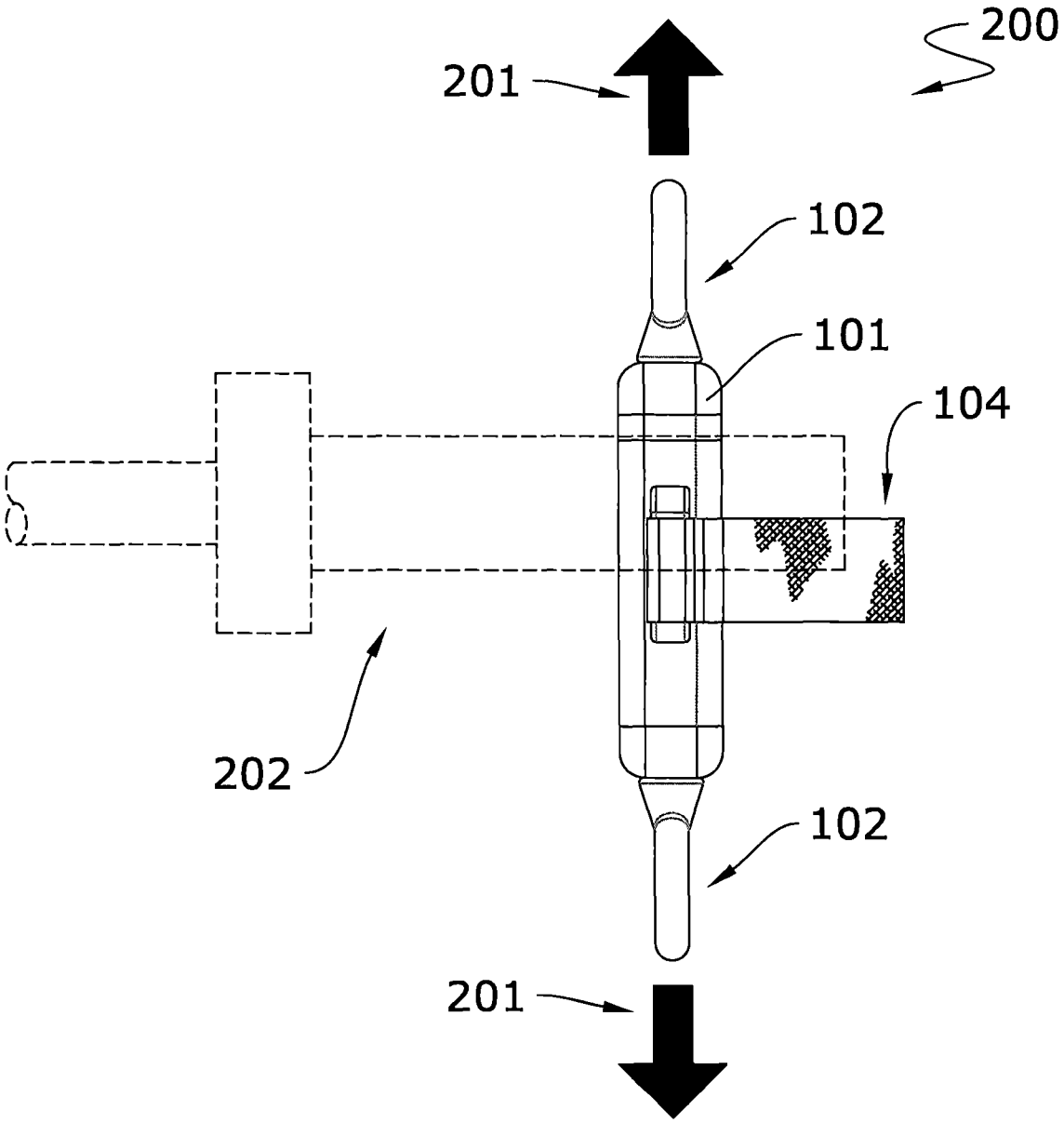
FIG. 2 is a side view of an exemplary embodiment of a device according to the present disclosure.

Turning now to FIG. 2. A side view of a device 200 according: disclosure is shown. In some arrangements, an axial load 201 is generated when the device is engaged with an article of exercise equipment via the attaching means 102. Such a load may cause the body to be deformed or experience mechanical strain. In some embodiments, the device may be attached to a barbell or dumbbell 202 which engages in motion, and while so engaged, may interact with the at least one sensor in said tracker. In any embodiment, it is envisioned that such a tracker may comprise an internal structure connecting the elements of the tracker body with at least each other or a sensor for transfer of load or strain therebetween. In any embodiment, the strain or deformation experienced by the device in response to utilization during an exercise or the like may be registered by the at least one sensor therein.

In another aspect, it is envisioned that the device is configured to encounter a force applied thereto and generate a signal therefrom that may be interpreted & stored by a computer and broadcast as exercise data. In such aspect, the device is resilient to the force encountered and remains undeformed thereafter. Further, it is envisioned the device is dimensioned and constructed such that the stress encountered generates zero plastic deformation.

Figure 3:
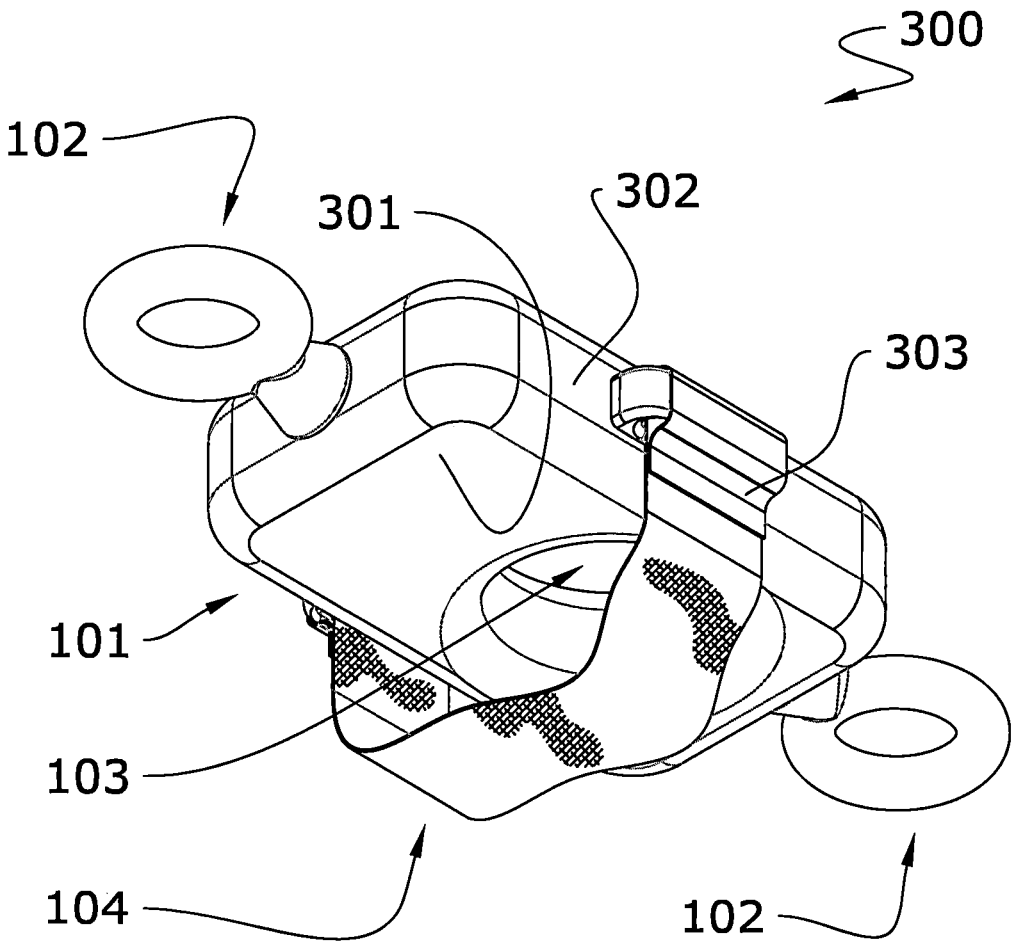
FIG. 3 is n isometric view of an exemplary embodiment of a device according to the present disclosure.

Turning now to FIG. 3, an isometric view of an exemplary embodiment of a device 300 according to the present disclosure is provided. In some embodiments, it is envisioned that the structural walls 301 of the device body 101 are configured to be load bearing. It is envisioned that any section or element of such a tracker may be load bearing including but not limited to the attachment means 102, hollow cavity 103, and/or the securement strap 104. In some embodiments, it is envisioned that the tracker body 101 or any part thereof is resilient to any or all load encountered. In some embodiments, a sensor area 301 is defined as an area within which at least one sensor is located and configured to data collection. In some embodiments, it is envisioned that the sensor area 301 is configured for containing a computer or processor. In some embodiments, such sensors and computers are operably connected to an external computer, processor, or communications device. In some embodiments, the securement strap 103 may include a strap adjustment 303 for manipulating the tension of the strap.

Figure 4:
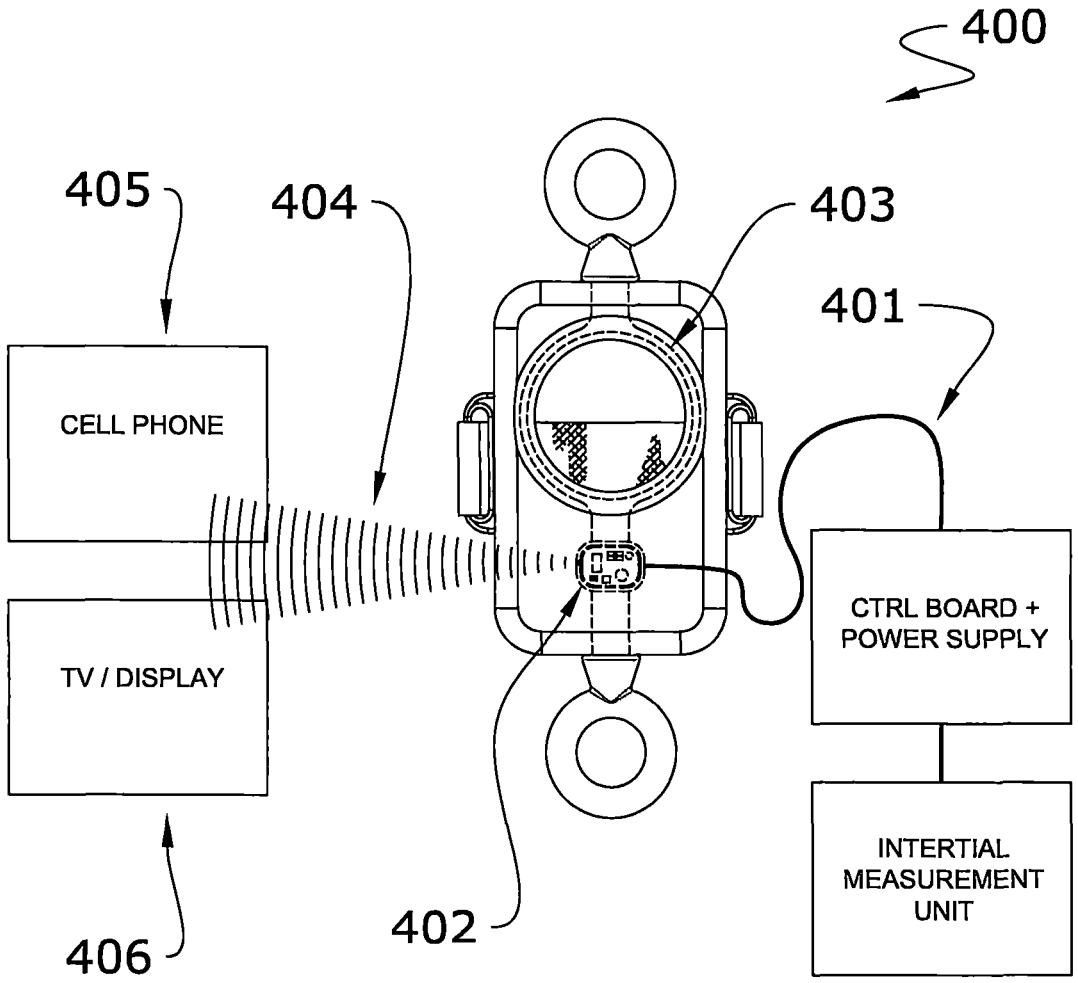
FIG. 4 is a schematic view of an exemplary embodiment of a device according to the present disclosure.

Consistent with FIG. 4 a schematic view 400 of an embodiment of the device as disclosed herein. FIG. 4 illustrates an exemplary schematic 401 of the device according to the present disclosure. It is envisioned that such a device includes at least one sensor or computational device 402. In any embodiment, the device may include a control board and power supply in operable communication with the at least one sensor. In any configuration, said sensor and computational array may be configured to collect, store, and render exercise data. In some embodiments the device is in operable communication with an external processor via wired connection (e.g., USB cable or the like) or wireless connection 404 (e.g., Bluetooth or Wi-Fi). In some embodiments, it is envisioned the computer or sensor is adapted to communicate with an external monitor such as a TV or computer screen 406 and display collected exercise data.

Continuing with FIG. 4, in some embodiments the invention disclosed herein may contain at least one sensor configured to measure and determine one or more of the following: inertia, position, acceleration, time, stress, load, force, strain, or the like. Examples of such sensors include, but are not limited to: strain gauge, gyroscope, potentiometer, accelerometer, etc. In some embodiments, a combination or plurality of sensors is included. In some embodiments, memory or data storage means are included. In some embodiments, computational means are include for processing and rendering of selected data.

List of Embodiments

The following examples are provided solely to illustrate the present invention and are not intended to limit the scope of the invention, described herein.

1. Embodiment 1. A device, the device comprising:
   a tracking unit defined by a hollow structure adapted for containing at least one sensor therein, and having an outer surface prepared with at least one hole;
   at least one computer operatively coupled to said tracking unit;
   wherein said at least one holes are configured to be detachably securable to an external surface; and
   wherein said at least one computer is configured to determine one or more force, torque, or power signals of the at least one sensor.
2. Embodiment 2. The device of Embodiment 1, further comprising a display operably connected to said computer.
3. Embodiment 3. The device of Embodiment 1, further comprising a hollow cylindrical structure disposed on said tracking unit and extending therethrough.
4. Embodiment 4. The device of Embodiment 1, further comprising at least one connection to an elastomeric band disposed on said tracking unit.
5. Embodiment 5. The device of Embodiment 1, further comprising a network, the network having at least one computer in communication with said device.
6. Embodiment 6. The device of Embodiment 5, further comprising at least one display configured to display workout data, said display being in communication with said network and said device.
7. Embodiment 7. The device of Embodiment 1, wherein said external surface comprises exercise equipment, such as a dumbbell, barbell or exercise machine.
8. Embodiment 8. The device of Embodiment 1, wherein the computer comprises electronics configured to determine at least acceleration, position, or resistance.
9. Embodiment 9. The device of Embodiment 1, wherein the computer is configured to store and retrieve collected data.
10. Embodiment 10. The device of Embodiment 1, wherein said computer is configured to plot and display collected data.
11. Embodiment 11. The device of Embodiment 1, wherein said at least one sensor is a strain gauge.
12. Embodiment 12. The device of Embodiment 1, wherein said at least one sensor is an accelerometer or gyroscope.
13. Embodiment 13. A method of obtaining data, the method comprises using the device of Embodiment 1 to tract data.
14. Embodiment 14. The method of Embodiment 13, further comprising the steps of:
    a. attaching the tracker unit to a piece of equipment prior to an exercise;
    b. performing an exercise that engages at least one sensor within said tracking unit;
    c. determining information from the exercise;
    d. storing and relaying said information via said computer;
    e. optionally interpreting said information in a kinematically or anthropomorphically correct form.
15. Embodiment 15. The method of Embodiment 14, wherein the determining occurs in real time.
16. Embodiment 16. The method of Embodiment 15, wherein power is calculated and displayed from said information from said exercise.
17. Embodiment 17. The method of Embodiment 15 or 16, wherein resistance is calculated and displayed from said information or power.
18. Embodiment 18. The method of Embodiment 14, further including the steps of plotting the information to track a travel path.
19. Embodiment 19. The method of Embodiment 14, further including communicating said information to a network having at least one computer and at least one display and optionally displaying said information through a room.
20. Embodiment 20. A physical activity tracker comprising:
    a module;
    a plurality of protrusion extending from said module, configured to be detachably couplable with a piece of exercising equipment;
    at least one force sensor programmed to output a force signal representing a force applied to said equipment;
    at least one processor in operable communication with said force sensor configured to receive the force signal and determine, from the force sensor, data;
    wherein said module is configured to track at least acceleration, position, or resistance.
21. Embodiment 21. The physical activity tracker of Embodiment 20, further comprising at least one hollow structure extending through said module.
22. Embodiment 22. The physical activity tracker of Embodiment 20, wherein said data is exercise data.
23. Embodiment 23. The physical activity tracker of Embodiment 20, further comprising a data storage medium adapted to store and retrieve the data.
24. Embodiment 24. The physical activity tracker of Embodiment 20, further comprising a data storage medium adapted to plot and display data.
25. Embodiment 25. The physical activity tracker of Embodiment 20, further comprising a network, said network includes at least one computer and display in common communication.
26. Embodiment 26. The physical activity tracker of Embodiment 23, wherein said display is configured to display data.
27. Embodiment 27. The physical activity tracker of Embodiment 20, wherein said at least one force sensor is programmed to output a force signal in response to a deformation of said module.
28. Embodiment 28. The exercise tracker of Embodiment 20, further comprising a battery electrically connected to at least one of said force sensors or said processor.
29. Embodiment 29. The physical activity tracker of Embodiment 20, wherein said battery is rechargeable or replaceable.
30. Embodiment 30. The physical activity tracker of Embodiment 20, wherein said protrusions are eyelets or hooks sizably configured to be received by said exercise equipment, such as a dumbbell, barbell or exercise machine.
31. Embodiment 31. The physical activity tracker of Embodiment 20, further comprising a connection to at least one cable or elastomeric band disposed on said module.

32. Embodiment 32. The physical activity tracker of Embodiment 20, wherein said force sensor is a strain gage.
33. Embodiment 33. The physical activity tracker of Embodiment 20, wherein said force sensor is an accelerometer.
34. Embodiment 34. The physical activity tracker of Embodiment 20, wherein said force sensor is a gyroscope.
35. Embodiment 35. The physical activity tracker of Embodiment 20, further comprising a display operably connected to said module configured for displaying information from said processor.
36. Embodiment 36. An exercise system, the system comprising:
   at least one item of exercise equipment having variable weight, at least one pulley, a cable, an elastomeric band, a barbell, or a dumbbell; and
   a tracker attached to said item of exercise equipment, the tracker having:
   a body;
   at least one eyelet disposed on said base, wherein said eyelet is configured to be releasably attachable to said item of exercise equipment; and
   at least one sensor programmed to output a signal representing movement, speed, position, acceleration, or resistance;
   at least one processor programmed to receive the force signal and determine, from the force signal, data.

Embodiments of the present disclosure are described herein, including the best mode known to the inventors for carrying out the invention. Variations of these embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the Embodiments appended hereto as permitted by applicable law. Moreover, any combination of the above-described elements in all possible variations thereof is encompassed by the invention unless otherwise indicated herein or otherwise clearly contradicted by context.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some, or all of the various embodiments mentioned herein, described herein and/or incorporated herein. In addition, the invention encompasses any possible combination that also specifically excludes any one or some of the various embodiments mentioned herein, described herein and/or incorporated herein.

Any information in any material (e.g., a United States patent, United States patent application, book, article, etc.) that has been incorporated this co herein, is only incorporated by reference to the extent that no conflict exists between such information and the other statements and drawings set forth herein. In the event of such conflict, including a conflict that would render invalid any Embodiment herein, then any such conflicting information in such incorporated by reference material is specifically not incorporated by reference herein.

The above disclosure is intended to be illustrative and not exhaustive. This description will suggest many variations and alternatives to one of ordinary skill in this art. All these alternatives and variations are intended to be included within the scope of the Embodiments where the term "comprising" means "including, but not limited to." Those familiar with the art may recognize other equivalents to the specific embodiments described herein which equivalents are also intended to be encompassed by the Embodiments.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages and proportions herein are by weight unless otherwise specified It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

This completes the description of the preferred and alternate embodiments of the invention. Those skilled in the art may recognize other equivalents to the specific embodiment described herein which equivalents are intended to be encompassed by the Embodiments attached hereto.

What is claimed is:

1. A device, the device comprising:
   a tracking unit having a body with a hollow structure adapted for containing at least one sensor therein, a hole through the body, and a pair of opposing attachment means for securing the tracking unit to an external item;
   wherein the tracking unit is configured to operatively couple the sensor to at least one computer;

wherein the hole through the body of the tracking unit is configured to be detachably and removably securable to an article of exercise equipment, wherein the hole is a non-elastomeric circular hole through the body, such that the body of the tracking unit is configured to slide on and off an article of exercise equipment;

wherein the article of exercise equipment is a barbell or dumbbell, and wherein an inner surface of the non-elastomeric circular hole comprises a non-slip coating configured to securely attach the tracking unit to said barbell or dumbbell while being detachable and removable; and wherein said at least one computer is configured to determine one or more force, torque, or power signals of the at least one sensor.

2. The device of claim 1, further comprising at least one connection to an elastomeric band disposed on said tracking unit.

3. The device of claim 1, further comprising a network, the network having at least one computer in communication with said device.

4. The device of claim 3, further comprising at least one display configured to display workout data, said display being in communication with said network and said device.

5. The device of claim 1, wherein the computer comprises electronics configured to determine at least acceleration, position, force, travel path, or resistance.

6. The device of claim 1, wherein the computer is configured to store and retrieve collected data.

7. The device of claim 1, wherein said computer is configured to plot and display collected data.

8. The device of claim 1, wherein said at least one sensor is at least a strain gauge, accelerometer, GPS, proximity sensor, or gyroscope.

9. The device of claim 1, wherein the body is configured to be releasably couplable to workout equipment.

10. The device of claim 1, wherein the computer is configured to interact with a network or cell phone application.

11. A physical activity tracker comprising:

a module;

a plurality of protrusions extending from said module, wherein at least a pair of protrusions are opposing attachment means for securing the tracking unit to an external item, wherein the attachment means configured to be detachably and removably couplable with a piece of exercising equipment;

a hole through a body of said module and configured to be securely attached to a piece of exercising equipment, wherein the hole is a non-elastomeric circular hole through the body, such that the body of the module is configured to slide on and off an article of exercise equipment;

wherein the piece of exercising equipment is a barbell or dumbbell, and wherein an inner surface of said non-elastomeric circular hole comprises a non-slip coating configured to securely attach the tracking unit to said barbell or dumbbell while being detachable and removable;

at least one force sensor programmed to output a force signal representing a force applied to said equipment;

at least one processor in operable communication with said force sensor configured to receive the force signal and determine, from the force sensor, data;

wherein said module is configured to track at least acceleration, position, or resistance.

12. The physical activity tracker of claim 11, wherein the inner surface of said hole comprising a non-slip coating configured to securely attach said module to said barbell or dumbbell enables the module to be clamped, adhered, fastened, or placed on the surface of said barbell or dumbbell.

13. The physical activity tracker of claim 11, wherein said at least one force sensor is programmed to output a force signal in response to a deformation of said module.

14. The physical activity tracker of claim 11, further comprising a battery electrically connected to at least one of the force sensor or the processor, wherein said battery is rechargeable or replaceable.

15. The physical activity tracker of claim 11, wherein said attachment means are eyelets sizably configured to be received by said exercise equipment, such as a dumbbell, barbell or exercise machine.

16. The physical activity tracker of claim 11, further comprising a connection to at least one cable or elastomeric band disposed on said module.

17. The physical activity tracker of claim 11, wherein said force sensor is a strain gage.

18. The physical activity tracker of claim 11, wherein said force sensor is an accelerometer.

19. The physical activity tracker of claim 11, wherein said force sensor is a gyroscope.

20. The physical activity tracker of claim 11, further comprising a band disposed on said tracker for securably attaching said device to at least one unit of exercise equipment.

* * * * *